US006708966B1

(12) United States Patent
Troudt

(10) Patent No.: US 6,708,966 B1
(45) Date of Patent: Mar. 23, 2004

(54) ADJUSTABLE C-CLAMP

(76) Inventor: Kevin Troudt, 12630 Etris Rd., Roswell, GA (US) 30075-1040

( * ) Notice: Subject to any disclaimer, the term of this patent is extended or adjusted under 35 U.S.C. 154(b) by 0 days.

(21) Appl. No.: 10/389,198

(22) Filed: Mar. 14, 2003

(51) Int. Cl.[7] ..... B25B 5/04
(52) U.S. Cl. ..... 269/249; 269/3; 269/6
(58) Field of Search ..... 269/249, 3, 6, 269/143; 29/276, 257

(56) References Cited

U.S. PATENT DOCUMENTS 189,767 A * 4/1877 Mole ..... 269/212
1,455,709 A * 5/1923 Burbank ..... 269/210
1,587,820 A * 6/1926 Carter ..... 269/140
2,675,839 A * 4/1954 Beasley ..... 269/208
4,627,604 A * 12/1986 Choi ..... 269/214

* cited by examiner

*Primary Examiner*—Lee D. Wilson
(74) *Attorney, Agent, or Firm*—David L. Tingey

(57) ABSTRACT

A C-clamp including a two-member back with a first member telescoping from a second member to a selective position where it is releasably secured. A securing mechanism, such as a cross pin or a ratchet a pawl in a rack on the first member, releasably secures the members together at a preferred position. In the preferred embodiment, the second member comprises a channel with the first member passing into the channel. Thus, the cross pin at the channel entry end engages one of a plurality of grooves in the top of the first member. To adjust the extent of the inner member from the outer member, it rotates out of the channel to separate the pin from the selective groove, allowing the inner and out members to adjust their relative position. Equivalently, the cross pin may remove from a groove of a nonrotating inner member.

8 Claims, 5 Drawing Sheets

ADJUSTABLE C-CLAMP

BACKGROUND

1. Field of the Invention

This relates to clamps generally, and more specifically to adjustable C-clamps.

2. Prior Art

It is well-known to have clamps generally in the form of a "C" formed by two arms depending from a back. Typically, a threaded rod passes through a matching threaded hole in the first arm and extends toward the second arm in such manner as an object can be secured between the second arm and the threaded rod.

A C-clamp is useful for securing objects of various sizes that fit between the threaded rod contact end and the second arm. Objects suitable for clamping by a given size C-clamp can range in size between a maximum when the threaded rod is effectively withdrawn away from the second arm and a minimum comparable to when the threaded rod is threaded through the hole toward the second arm essentially the full length of the threaded rod. For an object outside of this range, a C-clamp of a different size must be used. Commonly, a tool shop will have a wide range of C-clamps to accommodate objects of different sizes. Usually one will choose a C-clamp comparable in size to the object being clamped.

The primary object of the present invention is to have a C-clamp that is adjustable in effective width, extending the size range of objects that a single C-clamp can secure.

SUMMARY

This object is achieved in a typical C-clamp modified to include a two-member back with one member extending from the other to a selective position where it is releasably secured. In the preferred embodiment, a first member telescopes from a channel in a second member. Across the channel at its entry end is a pin. The channel web recedes from its entry end to provide a slot through which the first member enters under the pin. The pin blocks the channel at its top, so the first member enters the channel at an angle to the channel web and then rotates down onto the web and into engagement with the pin.

When the first member is rotated into contact with the channel web, the pin engages one of a plurality of grooves in the top of the first member to prevent the first member from moving in the channel. To later adjust the relative position of the first member in the channel, it is rotated away from the web and the pin. After the first member is repositioned, it is rotated back into contact with the web and the pin is received into a different one of the plurality of slots.

Significantly, when an object is clamped in the clamp, the object is forcibly pressed against an arm depending from the first member, which causes a rotational force on the first member. That is, the first member is urged up against the pin further locking the pin in the selective first member groove. The pin also becomes a fulcrum in a lever action that urges the first member portion in the channel hard against the channel web in a lever action causing increased frictional resistance to the first member sliding in the channel as well as maintaining the pin in the groove.

In an alternative embodiment, the pin moves in the second member out of engagement with the first member rather than the first member moving out of engagement with a stationary pin. In such case, the second member is typically a tube and the first member simply telescopes in and out of the tube. Typically, the pin passes through a transverse hole in the tube and into a selective one of a plurality of transverse holes in the first member aligned to receive the pin. The pin should be deemed only representative of many mechanisms known in the art that could releasably secure the back members together during use. Other configurations, such as a ratchet or a pawl in the second member engaging a rack on the first member are deemed equivalent to the pin.

DETAILED DESCRIPTION OF THE PREFERRED EMBODIMENT

Figure 1:
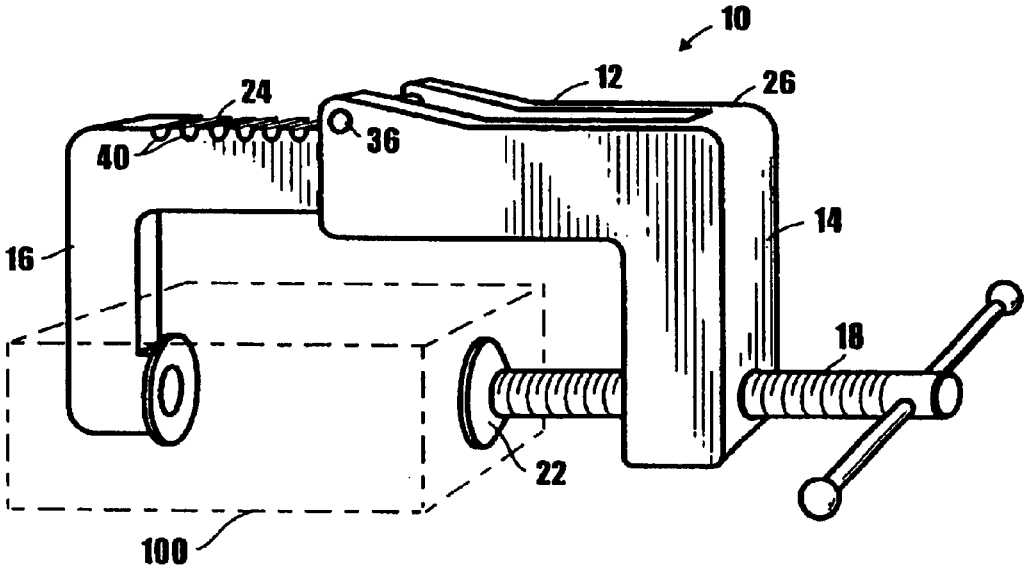
FIG. 1 is a flange perspective view of the adjustable C-clamp shown holding an object of near maximum width, the back members fully telescoping to maximum extent.
Figure 2:
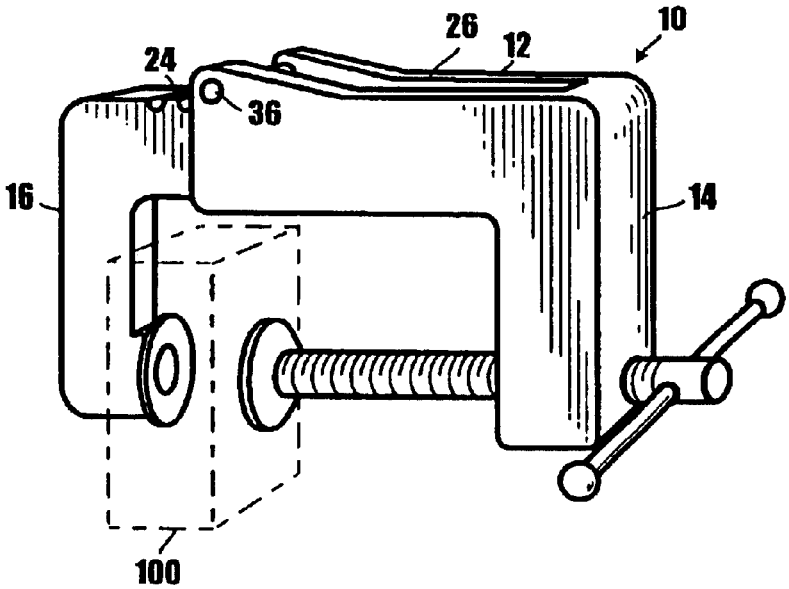
FIG. 2 is a flange perspective view of the adjustable C-clamp of FIG. 1 shown holding an object of near minimum width, the back members fully telescoping to minimum extent.
Figure 3:
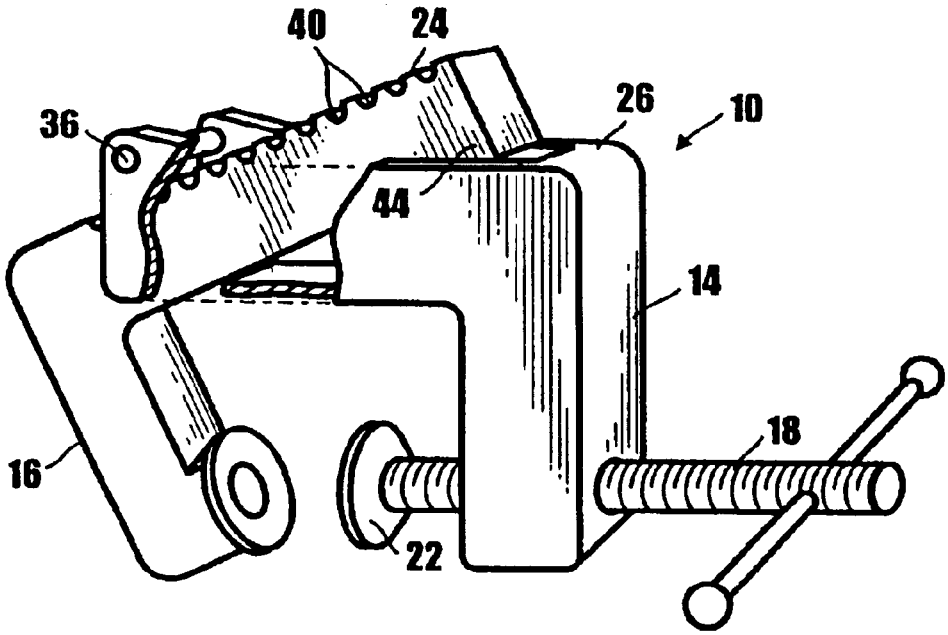
FIG. 3 is a flange perspective view of the adjustable clamp shown with the telescoping members mutually counter rotated into adjustable position from a position with the back members maximally telescoping together.
Figure 4:
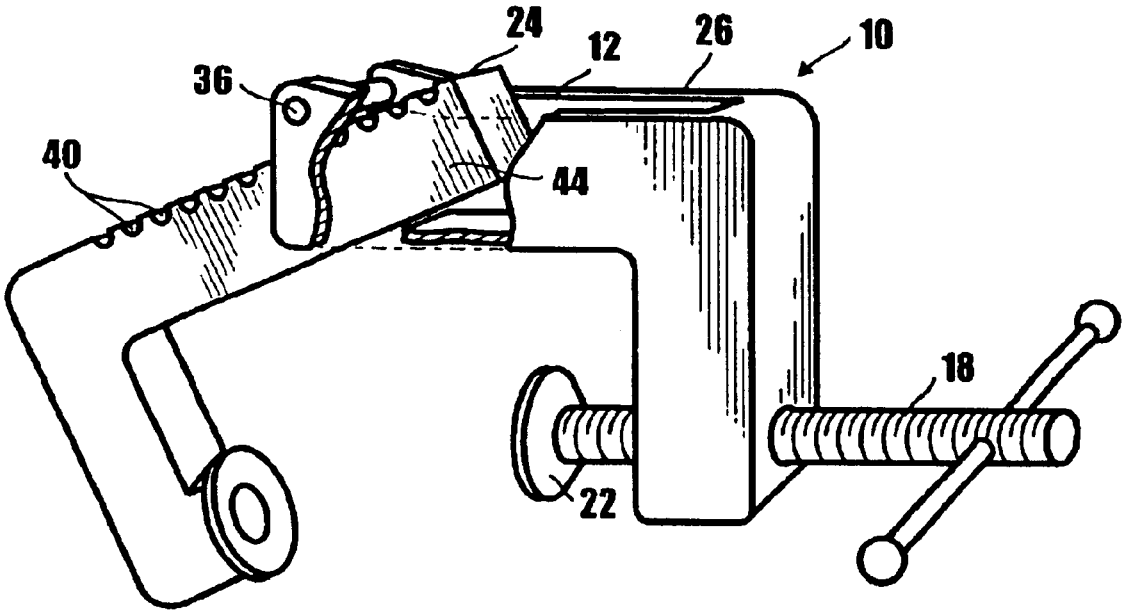
FIG. 4 is a flange perspective view of the adjustable clamp of FIG. 3 shown with the telescoping members in counter rotated relative position with the telescoping members adjusted into position maximally telescoping apart.
Figure 5:
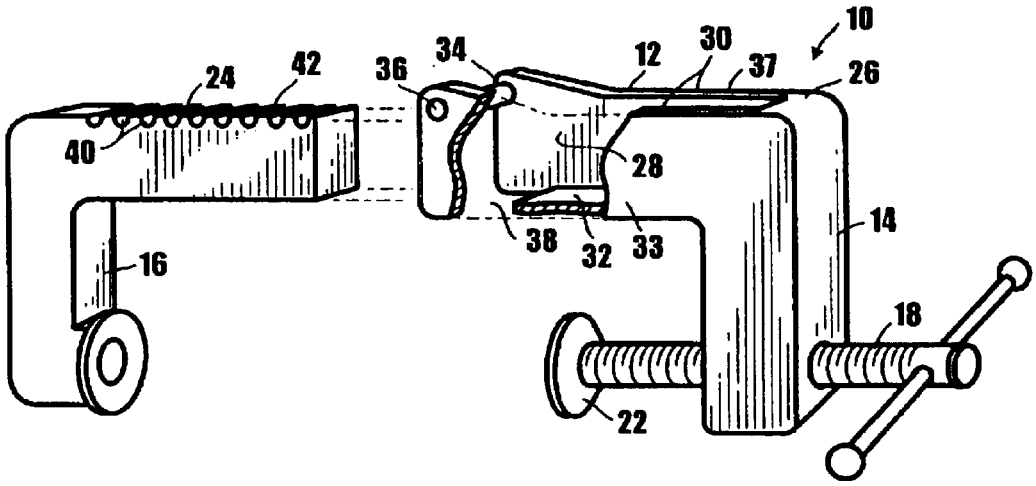
FIG. 5 is a perspective view of the adjustable clamp showing the inner back member with a series of transverse grooves aligned for entry into the channel of the outer back member. The cross pin across the entry end of the channel at its top, sized to fit in one of said grooves, blocks entry of the inner member requiring it to enter rotated at an angle through the slot between the cross pin and the receded channel web.
Figure 6:
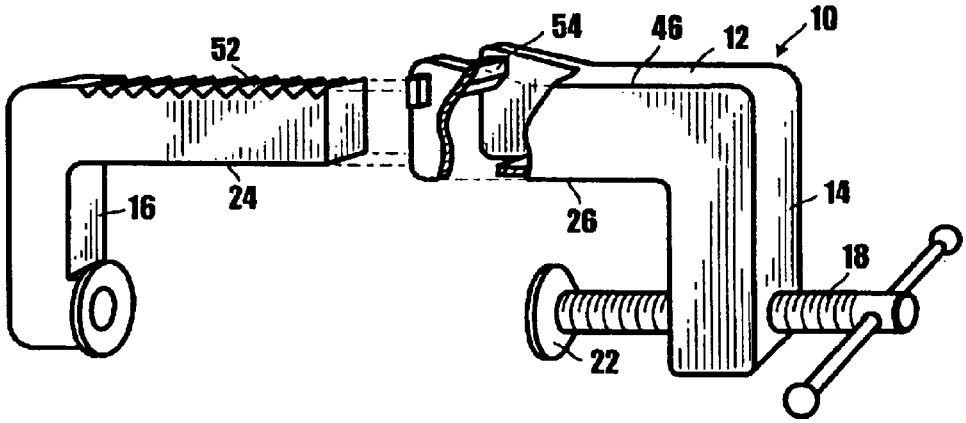
FIG. 6 is a perspective view of the adjustable clamp showing the inner back member with a rack on the top of the inner member and a pawl disposed for engagement with the rack as it enters the second member comprising a tube.
Figure 7:
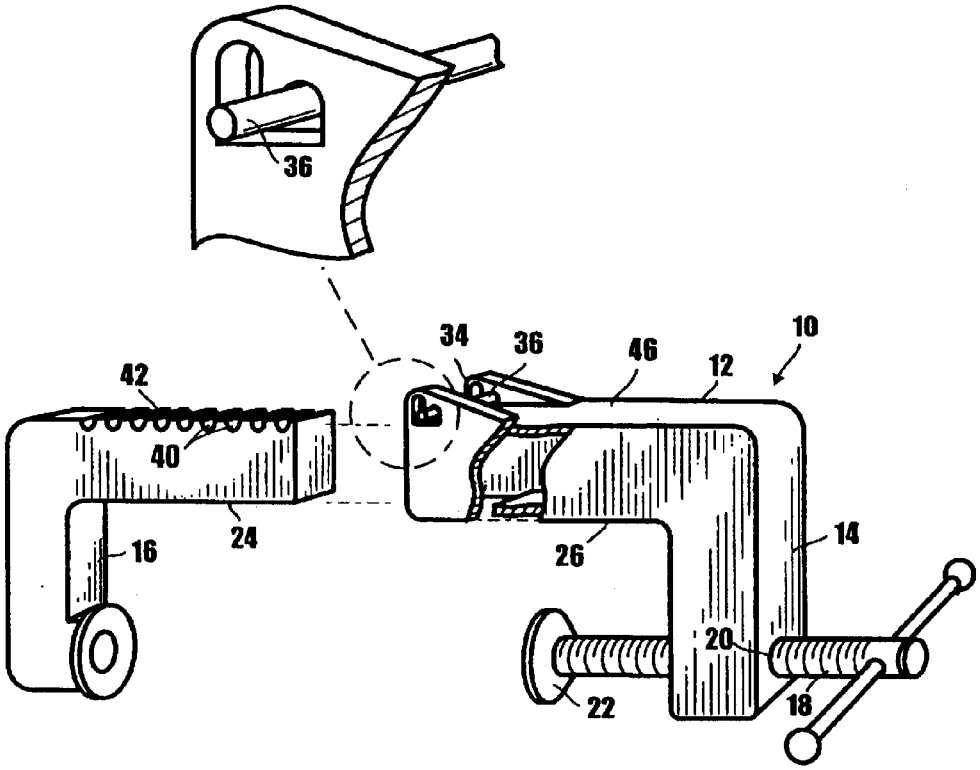
FIG. 7 is a perspective view of the adjustable clamp with the outer member comprising a tube and the cross pin shown removable from the grooves of the inner member.
Figure 8:
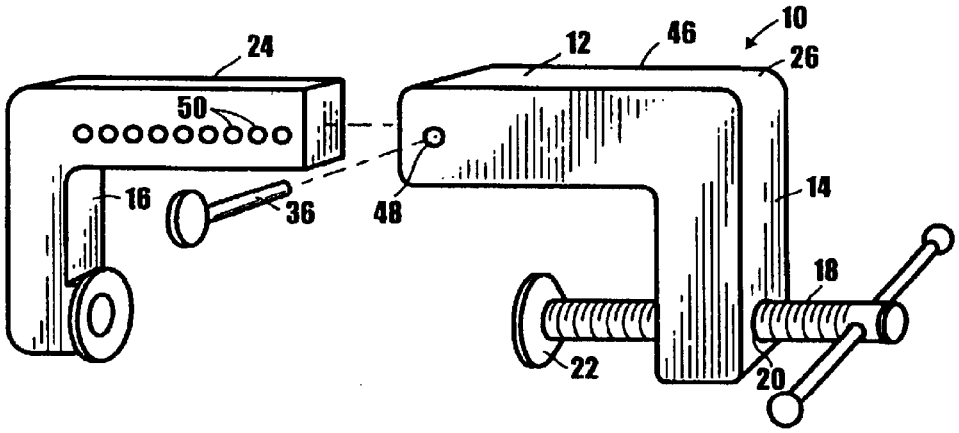
FIG. 8 is a perspective view of the adjustable clamp with the outer member comprising a tube with a hole through its sides and the cross pin shown insertable through those holes into a selective one of a plurality of holes in the inner member.
Figure 9:
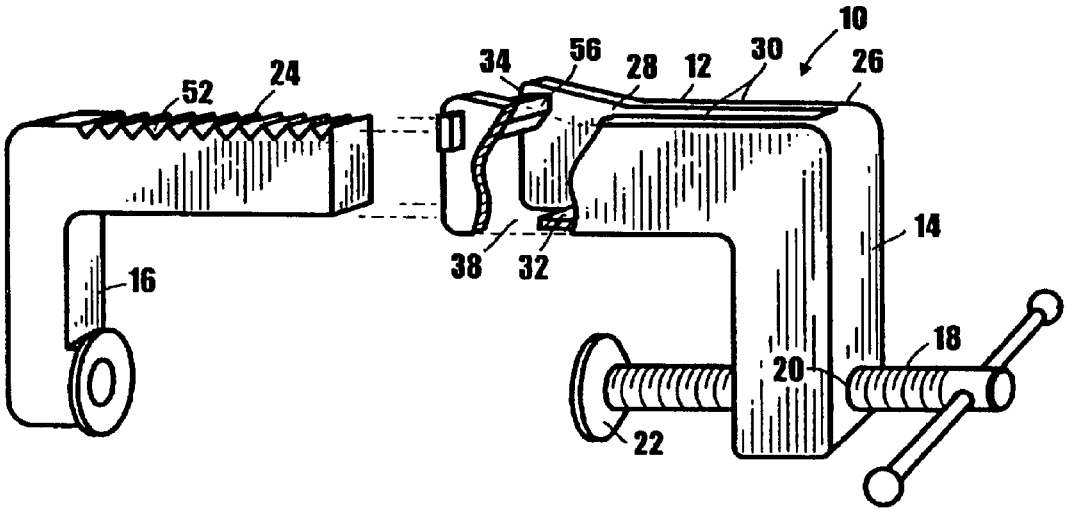
FIG. 9 is a perspective view of the adjustable clamp with the outer member comprising a tube, the inner member including a rack on its top, and a ratchet mechanism disposed to engage the rack as the inner member enters the tube.

The adjustable C-clamp 10 of the present invention comprises a back 12 and opposing first and second arms 14 and 16 depending from the back 12 to form a C-shaped frame. A threaded rod 18 moves through a matching threaded hole 20 in the first arm 14 directed toward the opposing second arm 16 adapted to clamp an object 100 by forcibly pressing the object between a contact end 22 of the threaded rod 18 and the second arm 16. The threaded rod 18 thus tightens against the object 100 to secure it within the clamp 10, typical of common C-clamps. (The threaded rod is only representative of any bar or other pushing member in adjustable and releasable engagement with the first arm where the bar is securable to the first arm at a preferred position. Any other form different from a threaded rod through a matching hole is deemed equivalent and included in this invention. For example, such a different form might be a rod secured in place by a cam urged to rotate on a pin against the rod.)

As stated, the clamp 10 becomes adjustable through a back first, or inner, member 24 telescoping from a back second, or outer, member 26. The first arm 14 depends from the outer member 26 and the second arm 16 depends from the inner member 24. The back inner member 24 releasably engages the back outer member 26 firmly and when thus engaged forms the frame back 12.

The back outer member 26 comprises a U-shaped channel 28 defined by opposing flanges 30 separated by a web 32 on flange proximal ends 33, the channel thus opening opposite the channel web 32. The back inner member 24 then telescopes out of the channel 28 at a channel entry end 34, sliding in the channel 28 between the opposing flanges 30 and resting on the channel web 32. In the preferred embodiment, the back inner member 24 enters the channel 28 at its entry end 34 under a cross pin 36 that bridges between opposing flanges 30 at the channel entry end 34 on flange distal ends 37, partially obstructing passage into the channel 28 at its top (opposite the web). To allow the inner member 24 to pass into the channel 28, channel web 32 recedes from the entry end 34 longitudinally spacing the cross pin 36 from the channel web 32 defining therebetween a disengagement slot 38 that allows the back inner member 24 to enter the slot 38 at an acute angle from the back web 32. When the back inner member 24 is located at a preferred position, it is rotated toward and into contact with the channel web 32 where a selective one of a plurality of grooves 40 in the back inner member top 42 engages the cross pin 36 to prevent the back inner member 24 to slide in the channel 28. To adjust the relative position of the back members 24 and 26, the back inner member 24 is again rotated into the disengagement slot 38 away from the channel web 32 to disengage the cross pin 36 from the grooves 40 of the back inner member 24. The back inner member 24 then slides to a new preferred position and rotated back toward the web 32 to again engage the cross pin 36.

In operation, when an object 100 is secured in the adjustable C-clamp 10, the threaded rod 18 pushes the object 100 against the second arm 16. That push causes a rotational force on the back inner member 24 that urges it against the cross pin 36 intermediate the back inner member 24 into firm engagement with the grooves 40. The rotational force also presses a back inner member portion 44 within the channel 32 against the channel web 32 as the cross pin 36 becomes a fulcrum for rotation of the back inner member. The back inner member 24 is thus prevented from telescoping from the back outer member 26 during use both by the secure engagement of the cross pin 36 in the grooves 40 and by the force pressing the back members together.

In an alternate embodiment, the cross pin 36 is moveable instead of stationary in the flanges 30. The cross pin 36 and grooves 40 of the back inner member 24 are disengaged by moving the pin 36 instead of rotating the back inner member 24. In this embodiment, the disengagement slot 38 is not required and the back inner member 24 simply slides horizontally within the back outer member 26, which then may be a tube 46 instead of a channel. The cross pin 36 likewise may be removable from the flanges 30 and reinserted through a transverse hole 48 in the tube 46 aligned with a selective one of a plurality of holes 50 in the back inner member 24.

It is noted that the cross pin 36 is representative of several securing mechanisms known in the art that might be employed for engaging the back inner member 24 with the back outer member 26. In alternative embodiments, one of those securing mechanisms may substitute for the cross pin 36 without detracting from the invention and is deemed included in this disclosure. In one such alternative, the grooves 40 on the inner member 24 may comprise a rack 52 and the cross pin 36 may comprise a removable pawl 54 engaging the rack 52. Thus, the rack 52 slides under the pawl 54 to a preferred position and then held in that position during use. It is then released or withdrawn for adjustment of the back inner and outer members 24 and 26. Likewise, a ratchet 56 is a similar mechanism to control relative movement of the back members that is deemed included in this disclosure.

Significantly, the securing mechanism is not required to sustain longitudinal force derived when the threaded rod 18 forcibly presses the object 100 between its contact end 22 and the second arm 16. Rather, it is required only to hold the back inner member 24 in its longitudinal relation to the back outer member 26 while the back inner member 24 receives the rotational force generated by the bar against the second arm 16. The rotational force then urges the back inner member 24 against the back outer member 26. When the outer member 26 is a tube 46, the rotational force urges the back inner member 24 up at the tube entry end 34, which becomes an effective fulcrum at the entry end causing the portion of the back inner member in the tube to push down against the tube. This upward and downward force in the tube significantly prevents the back inner member from moving within the tube in concert with the securing mechanism. The mechanism therefore can be of less structural strength than if it alone had to sustain the pushing force of the bar.

Having described the invention, what is claimed is as follows:

1. An adjustable C-clamps including a back and opposing first and second arms depending from the back forming a frame in a C shape, a bar in releasable engagement with the first arm directed toward the second arm to clamp an object therebetween, adapted to press the object between a contact end of the bar and the second arm, the bar securable to the first arm at a preferred position, the back comprising, a back outer member with said first arm depending therefrom, a back inner member with said second arm depending therefrom, the back inner member releasably engaging the back outer member adjustably at a selective position relative to the back outer member therein effecting a back of adjustable length, opposing flanges separated by a channel web at flange proximal ends therein forming a U-shaped channel opening opposite the web with an entry end through which the back inner member enters the channel, the back inner member fitting slidably between the opposing flanges.

2. The adjustable C-clamp of claim 1 further comprising a ratchet mechanism controlling relative movement of the back inner and outer members.

3. An adjustable C-clamp including a back and opposing first and second arms depending from the back forming a frame in a C shape, a bar in releasable engagement with the first arm directed toward the second arm to clamp an object therebetween, adapted to press the object between a contact end of the bar and the second arm, the bar securable to the first arm at a preferred position, the back comprising, a back outer member with said first arm depending therefrom, a back inner member with said second arm depending therefrom, the back inner member releasable engaging the back outer member adjustably at a selective position relative to the back outer member therein effecting a back of adjustable length, opposing flanges separated by a channel web at flange proximal ends therein forming a channel opening opposite the web with an entry end through which the back inner member enters the channel, the back inner member fitting slidably between the opposing flanges, a cross pin bridging between opposing flanges at the channel entry end partially obstructing passage into the channel at flange distal ends.

4. The clamp of claim 3 wherein the channel web recedes from the entry end longitudinally spacing the cross pin from the channel web defining therebetween a disengagement slot enabling the back inner member to enter the slot at an acute angle from the back web, therein enabling the inner member to pass into the channel under the cross pin.

5. The clamp of claim 3 wherein the back inner frame further includes a plurality of grooves in its top, a selective one of which engaging the cross pin when the back inner frame is rotated against the channel web therein preventing the back inner member from sliding in the channel.

6. The clamp of claim 5 wherein the back inner member is disposed in the back outer member such that when the threaded rod pushes the object against the second arm, it causes a rotational force on the back inner member urging it against the cross pin intermediate the back inner member thereby pressing a back inner member portion within the channel against the channel web as the pin becomes a fulcrum therein maintaining the back members together and the cross pin in firm engagement with the grooves of the back inner member, therein preventing the back inner member from telescoping from the back outer member during use.

7. An adjustable C-clamp comprising a back including interconnecting inner and outer members, the inner member telescoping from the outer member under a cross pin bridging opposing flanges of the outer member near an outer member first end telescopically receiving an inner member first end, and opposing first and second arms depending from outer and inner members respectively forming a C-shape, a pushing member extending from the first arm toward the second arm adapted to secure an object between the pushing member and the second arm, the pushing member causing a rotational force on the second arm urging the inner member from which it depends against the cross pin intermediate the inner member and pressing the inner member first end against the outer member, the pin becoming a fulcrum, therein maintaining the inner and outer members together, the cross pin resistively engaging the inner member under said rotational force, releasable absent that rotational force, therein preventing the inner member from telescoping from the outer member when said object is secured between the pushing member and the second arm.

8. In a clamping frame having a back and opposing first and second arms depending from the back forming a frame in a C shape, the back comprising a first member and a second member adjustably engaged a bar in movable engagement with the first arm directed toward the second arm adapted to forcibly press an object between a contact end of the bar and the second arm in clamping the object therebetween, the bar securable to the first arm at a preferred position a channel defined by a opposing flanges separated by a web and an entry end into which the second member enters the channel, a releasable securing mechanism securing the first member to the second member at a preferred position comprising a cross pin bridging the flanges at a channel top near the entry end and the second member includes a plurality of grooves on its top sized to receive the cross pin, the pin disposed to fit within a selective groove when the second member is within the channel against the channel web,) the method of adjusting an operational size of the frame by adjusting an effective length of the back, comprising the following steps:

a. Releasing the securing mechanism from securing the first member to the second member by rotating the second member away from the web such that the pin separates out of the selective groove, b. Adjusting the position of the first member relative to the second member, c. Rotating the second member back into engagement against the channel web such that the pin is again received into a selective one of the plurality of grooves.

* * * * *